US005204846A

United States Patent [19]

Brahaney

[11] Patent Number: 5,204,846

[45] Date of Patent: Apr. 20, 1993

[54] DUAL TIME-INDICATIVE TIME PIECE

[76] Inventor: Garth T. Brahaney, 27 Field Point Dr., Greenwich, Conn. 06830

[21] Appl. No.: 734,903

[22] Filed: Jul. 24, 1991

[51] Int. Cl.[5] ..... G04B 19/04

[52] U.S. Cl. ..... 368/228; 368/223; 368/285

[58] Field of Search ..... 368/80, 301-307, 368/285, 223-239, 240-243

[56] References Cited

U.S. PATENT DOCUMENTS

| | | | |
|---|---|---|---|
| D. 145,610 | 9/1946 | Banick . | |
| D. 258,120 | 2/1981 | Muramatsu . | |
| D. 292,890 | 11/1987 | Schoepfer . | |
| D. 308,178 | 5/1990 | Zaboyan . | |
| 1,989,584 | 1/1935 | Biedenfeld | 368/223 |
| 2,169,099 | 8/1939 | Ketterson | 58/2 |
| 2,310,582 | 2/1943 | Jefferson | 58/57 |
| 4,043,116 | 8/1977 | Schläppi | 58/88 |
| 4,370,063 | 1/1983 | Lee | 368/71 |
| 4,444,513 | 4/1984 | Proellochs | 368/223 |
| 4,720,820 | 1/1988 | Siefert | 368/76 |
| 4,979,155 | 12/1990 | Tung | 368/223 |

*Primary Examiner*—Bernard Roskoski
*Attorney, Agent, or Firm*—Brumbaugh, Graves, Donohue & Raymond

[57] ABSTRACT

An analog time-indicating device, such as a watch, which can be read from either of two opposite view points, has time information displayed on its face in a circular array of twelve hour-representing indicia of which two diametrically opposite indicia, visually distinguishable from each other, serve to indicate first and second twelve o'clock reference positions. The watch has two sets of hour and minute hands, corresponding hands of which are displaced from each other by 180°. The sets of hands are visually distinguishable from each other by size and color and are coordinated by color with the indicia representing the twelve o'clock reference positions to give an observer visual information for matching a set of hands with the twelve o'clock reference position appropriate for correct time indication.

15 Claims, 2 Drawing Sheets

DUAL TIME-INDICATIVE TIME PIECE

BACKGROUND OF THE INVENTION

The present invention relates to time-indicating devices and, more particularly, is directed toward a dual time-indicating device such as an analog watch which can be observed in proper perspective from opposite view points.

The most common face for a time piece, especially for watches, is of the continuous analog type consisting of a time-graduated scale arranged in a circle, and hour and minute hands each secured at one end to hour and minute shafts of a suitable drive mechanism contained within the case. The minute hand is usually longer than the hour hand, and a second hand, if provided, is usually long and very narrow. A full revolution of the hour hand takes twelve hours, while the minute hand makes a full revolution in one hour. A reference marking on the scale, usually at the top of the dial, indicates twelve o'clock, representing the beginning and mid-point of each 24-hour day. The markings may be Arabic or Roman numerals, or other symbolic form, and the reference mark is usually accompanied by eleven other indices of the same form to indicate the other hours of the ante meridiem (A.M.) and post meridiem (P.M.) parts of the day. The symbols are not necessarily differentiated from each other, nor are twelve required, since the position of each relative to the twelve o'clock symbol, or other reference point, is indicative of the hour it represents; e.g., the position directly opposite the twelve o'clock position represents six o'clock whether so marked or not.

The continuous analog dial time piece is designed to be read from only one view point; in the case of a wrist watch it is usually worn to be viewed by the wearer when the back of the hand is turned toward the wearer. To a person facing the wearer, even if the wearer's arm is turned toward the person, the watch face would be inverted and, therefore, inconvenient to read. Similarly, the face of a time piece hung around the neck, or held by a pendant to be hung from clothing, is normally oriented with the twelve o'clock indicia at the bottom so as to be placed in proper perspective for reading when lifted up to face the wearer. Again, to a person facing the wearer the face of the hanging watch appears inverted.

To take advantage of recent fashion trends which encourage and promote the wearing of time pieces, especially watches of unconventional designs, materials and colors, a need exists for a time piece which can be observed and read with equal ease from opposite view points.

It is a primary objective of the present invention to provide a time indicating watch which shows, on a single face, time going forward clockwise when viewed from either of two opposite view points.

Another object of the invention is to provide a dual time-indicating watch of the character described without the need for a special drive mechanism.

SUMMARY OF THE INVENTION

Briefly, these and other objects of the invention are achieved by modifying a conventional analog time piece, such as a watch, in a novel way which enables it to be read from two opposite view points. Instead of the usual dial face, the watch face according to the invention has a continuous time-graduated scale including two diametrically opposite indicia indicative of the usual twelve o'clock position in the up and in the inverted orientation, respectively, of the dial face. The usual hour and minute hands are replaced with two pointers each of which is attached to and extends in both directions from the shaft of the drive mechanism of the watch, one forming two hour hands displaced from each other by 180° and the other forming two minute hands also displaced from each other by 180°. The two sets of hour/minute hands are distinguished from each other by color for example, and are similarly color-coordinated to the appropriate twelve o'clock reference indicia on the time graduated scale. Thus, one set of hands indicates the time with respect to its respective time-graduated scale when its twelve o'clock position is up, and the other set correctly indicates the time when viewed from the opposite direction.

Other objects, features and advantages of the invention will become apparent, and its construction and operation better understood, from the following detailed description read in conjunction with the accompanying drawings.

DETAILED DESCRIPTION OF PREFERRED EMBODIMENTS

Figure 1:
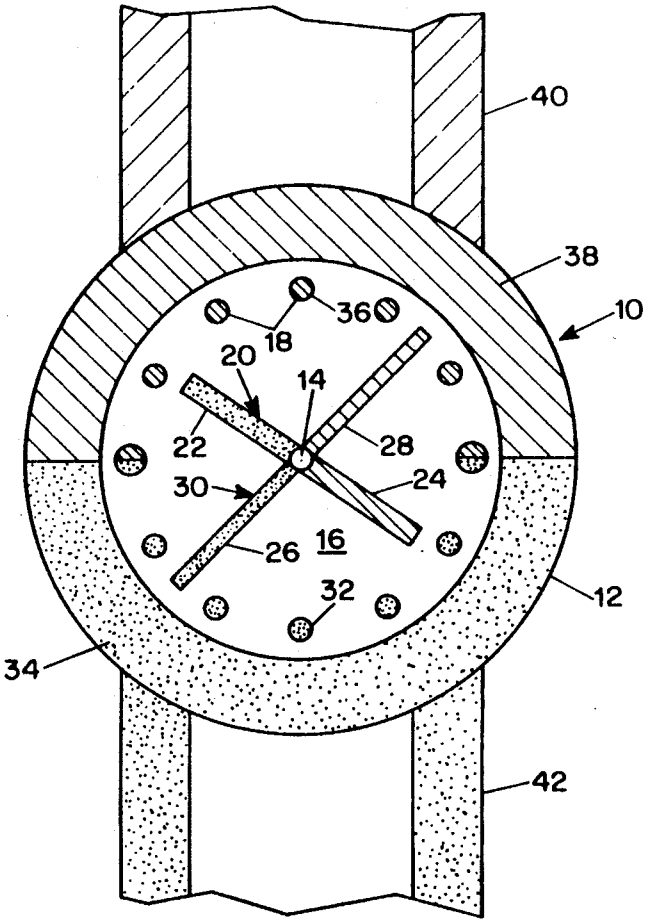
FIG. 1 is a plan view of a wrist watch according to a first embodiment of the invention.

Referring to FIG. 1, the time piece according to one embodiment of the invention is shown as a watch 10 having a conventional case 12 containing any suitable analog drive mechanism (not shown) for driving a shaft 14 to which hour and minute hands would normally be connected. The face 16 which is shown as being circular but may be any of the usual watch shapes, has a time-graduated scale arranged in a circle, with shaft 14 as its center, consisting of markings 18 to indicate the twelve hours of the AM and PM portions of a twenty-four hour day.

Instead of the usual hour and minute hands, the present watch has two sets of hour and minute hands: the hour hands comprise portions 22 and 24 of a pointer member 20 that extend in opposite directions from its point of attachment to the "hours" shaft of the drive mechanism, and the minute hands comprise the portions 26 and 28 of a pointer member 30 that extend in opposite directions from its point of connection to the "minute" shaft of the drive mechanism. In this embodiment, the two hour hands 22 and 24 are of the same length, and the minute hands, also, are of equal length but longer than the hour hands. The hour hands, which are displaced from each other by 180°, are distinguished from each other by color or other feature: in FIG. 1 hour hand 22 is stippled to represent a first color whereas the other hour hand 24 is cross-hatched to represent a second color. Similarly, minute hand 26, which operates in conjunction with hour hand 22 to indicate the time when one of the twelve o'clock markings is in the up position, is stippled and the other minute hand 28 is cross-hatched.

The twelve o'clock reference position 32 associated with the set of hands 22 and 26 is located at the mid-point of an arcuate band 34 which extends clockwise around half of the peripheral edge of the face 16 that lies between three o'clock and nine o'clock. Similarly, the twelve o'clock reference position 36 associated with the other set of hands 24 and 28 is located at the mid-point of the hatched arcuate band 38 which extends clockwise around the watch from nine o'clock to three o'clock. To provide further coordination between the twelve o'clock positions and the appropriate set of hands, the indicia 18 subtended by arcuate band 34 are also stippled whereas the indicia subtended by band 38 are cross-hatched, and the portions 40 and 42 of the strap of the watch are matched in color (or other distinguishing feature) to that of the adjoining arcuate band.

When the watch is in the position shown in FIG. 1, that is, with the twelve o'clock reference 36 of the hatched portion 38 of the dial directed upwardly, and with the pointers 20 and 30 in the positions shown, the hatched hour hand 24 points to the fourth indicia clockwise from the twelve o'clock reference, which represents four o'clock with respect to the center of rotation 14 and the twelve o'clock reference 36, and the hatched minute hand 28 points to a position which when related to the twelve o'clock reference 36 represents eight minutes after the hour. Thus, when the watch is observed from this view point, the hatched set of hands indicate that the time is 4:08.

If FIG. 1 is rotated by 180° so as to represent how the inverted watch face would appear from the opposite view point, it is clear that only with difficulty can the time be read from the positions of the hatched hands 24 and 28. However, in this inverted position the twelve o'clock reference 32 centered on the stippled band 34 is at the top of the dial, and by virtue of the stippled hands 22 and 26 being displaced by 180° from hands 24 and 28, respectively, the hour hand 22 points to the indicia which represents four o'clock with respect to the center of rotation 14 and the twelve o'clock reference 32, and minute hand 26 points to a position which when related to the twelve o'clock reference 32 represents eight minutes after the hour. Thus, when viewed from the opposite view point the stippled hands indicate a time of 4:08. Thus, it is seen that the watch can be correctly observed from either of two opposite view points.

Figure 2:
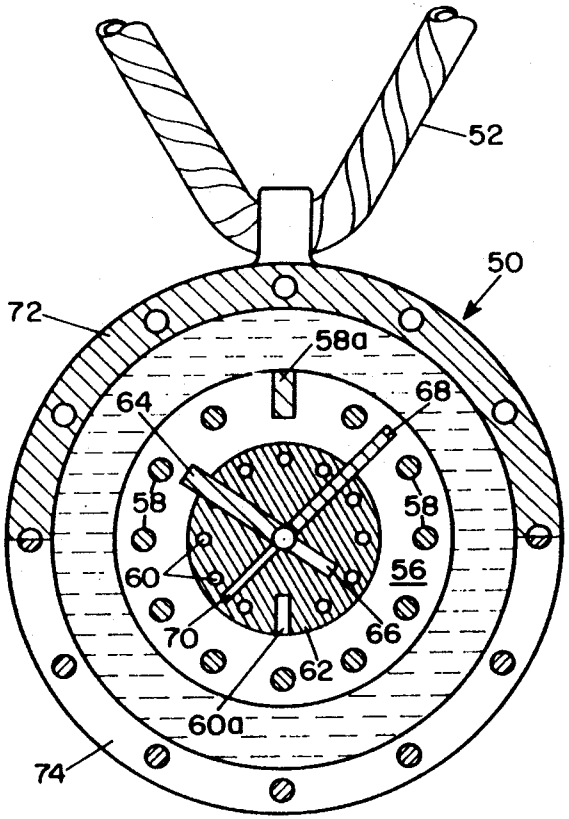
FIG. 2 is a plan view of a pendant watch according to a second embodiment of the invention.

An alternative embodiment of the essential feature that there be two sets of hour/minute hands with the hands of one set displaced from corresponding hands of the other set by 180° and two twelve o'clock reference points separated by 180°, is shown in FIG. 2. Here, the time piece is a pendant watch 50 intended to be worn around the neck on a cord 52, which may be multi-colored and coordinated with colors employed to visually distinguish parts of the watch face from each other. A suitable analog drive mechanism (not shown) contained in the watch case drives hour and second shafts disposed at the center of a circular dial face 56. The face has two time-graduated scales of differing diameters: an outer circular scale consisting of hour-representing indicia 58, shown cross-hatched to represent a color or other distinguishing feature, including a twelve o'clock reference mark **58*a* of a different shape than the others, and an inner circular scale consisting of hour-representing indicia 60, shown as being white on a circular contrasting field 62, which may be the same color as the indicia 58, of the outer scale including a twelve o'clock reference mark 60*a* of a different shape than the others which is displaced by 180° from reference mark 58*a*** of the outer scale.

As in the FIG. 1 embodiment, the watch has two sets of hour and minute hands: the hour hands 64 and 66, which respectively cooperate with the outer and inner scales, are portions of a first pointer member that extends in opposite directions from the center, and the minute hands 68 and 70, which respectively cooperate with the outer and inner scales, are portions of a second pointer mounted on the "minutes" shaft of the drive mechanism. The hour and minute hands 64 and 68 are the same color as the outer scale indicia toward which they point, and the hour and minute hands 66 and 70 are visually distinguishable from the other set by being a different color, the same as that of the indicia 60, and by being shorter to accommodate to the smaller diameter of the inner scale.

The sets of hands are coordinated with the twelve o'clock reference indicia not only by the distinguishing color and size of the twelve o'clock indicia **58*a* and 60*a* of the two scales, but also by an arcuate band 72 of the same color as the outer scale indicia which extends around the half of the dial perimeter that is centered at the outer scale indicia 58*a*, and by a band 74 of the same color as the inner scale indicia 60** and the shorter set of hands which extends around the other half of the perimeter.

When viewed in the FIG. 2 position, the upwardly directed reference indicia **58*a* indicates to the observer that the like-colored hands 64 and 68 are to be used with the outer scale indicia of the same color to indicate the time which, in the illustrated case, is approximately 10:08 to a person facing the wearer of the pendant watch. From the view point of the wearer when the watch is turned up for reading, the twelve o'clock indicia 60*a* of the inner scale is directed upwardly, indicating that the like-colored hands 66 and 70 are to be used in association with the like-colored inner scale. If FIG. 2 is turned upside down it will be seen that a time of 10:08 is indicated on the inner scale. Thus, in the FIG. 2** embodiment two sets of characteristics, size and color, serve to visually distinguish the two sets of hands from each other and to associate each set with a particular twelve o'clock reference point.

Figure 3:
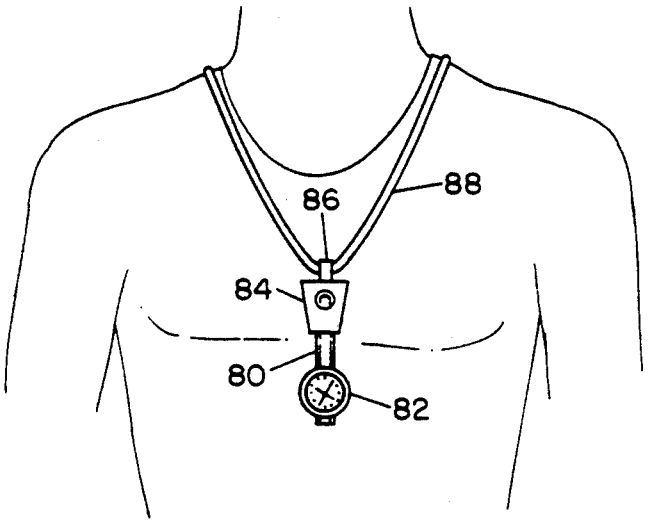
FIG. 3 is a fragmentary view showing a watch embodied in a pendant hung from a cord.
Figure 4:
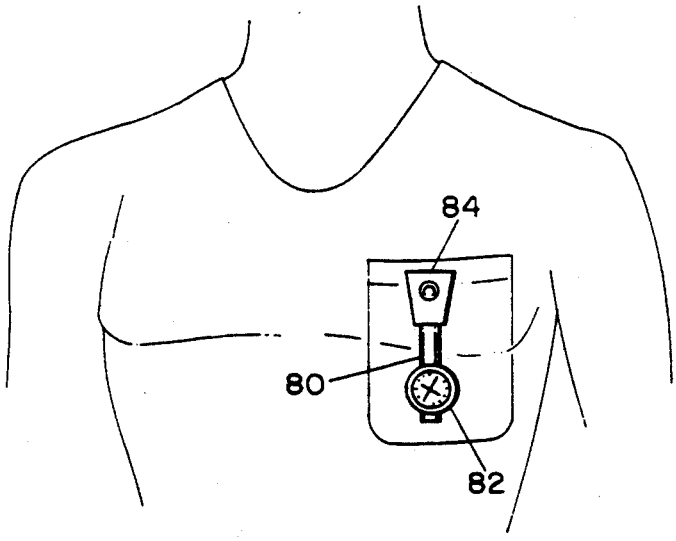
FIG. 4 is a fragmentary view showing a watch embodied in a pendant hung from the clothing of a wearer.

The wrist watch of the invention being readable from either of two opposite view points it is admirably suited for also being alternatively worn as a hanging pendant hung either from the neck on a cord or chain, or from an article of clothing. Referring to FIGS. 3 and 4, the straps 80 of a wrist watch 82, having a face as shown in either FIG. 1 or FIG. 2, is shown grasped by a fastener 84 having a hook 86 formed at its upper edge for engaging a cord 88 hung around the neck of the wearer (FIG. 3) or the upper edge of a garment pocket (FIG. 4) or a belt. The fastener 84, which may be formed of metal or other suitable material, enables the dual-time indicating wrist watch to be worn in any of three different ways: as part of a conventional wrist watch; as part of a pendant hanging from the neck on a cord or chain; or, as a pendant-like appendage to an article of clothing. When hanging the watch can be conveniently read by a passerby associating one set of hands with the appropriate time indicating scales, and the wearer can read it by lifting it up and associating the other set of hands with the other scale.

While particular embodiments of the invention have been illustrated and described, it will be understood that the invention is not limited thereto since modifications may now be made by those skilled in the art. For example, the elongated pointer members forming the hands may be replaced with other types of pointers, such as dots on clear rotating discs for pointing out time. Non-mechanical hands, using a liquid crystal diode display to point out the time with respect to a time graduated scale, could also be used. It is, therefore, intended by the following claims to cover any such modification as comes within the spirit and scope of the invention.

I claim:

1. A dual time-indicating time piece having two distinguishable sets of time-indicating means, each of which can be read with respect to separate and opposite reference indicia, said time piece comprising:

a case, analog drive means mounted within said case, a face having a center mounted in said case, said face having display means distributed around said center for displaying continuous analog time information representative of twelve hours, said time information including first and second twelve o'clock representing indicia angularly displaced from each other by 180° with respect to said center, a first set of hour and minute indicating means coupled to and driven around said center by said drive means for cooperating with said analog time information to indicate time with respect to said first twelve o'clock representing indicia, said first hour indicating means being driven around said center at a rate of one revolution per every twelve hours and said first minute indicating means being driven around said center at a rate of one revolution per every sixty minutes, a second set of hour and minute indicating means coupled to and driven around said center by said drive means and respectively continuously displaced from the hour and minute indicating means of said first set by 180°, the indicating means of said second set being visually distinguishable from the indicating means of said first set and cooperating with said analog time information to indicate time with respect to said second twelve o'clock representing indicia, and means for coordinating said first and second sets of indicating means with said first and second twelve o'clock representing indicia, respectively, whereby said time piece can be read in a first attitude wherein the first twelve o'clock representing indicia is viewed in a position which corresponds to the twelve o'clock position of a conventional time piece with the first set of hour and minute indicating means being read with respect to said first twelve o'clock representing indicia, and whereby said time piece can be read in a second attitude wherein the second twelve o'clock representing indicia is viewed in a position which corresponds to the twelve o'clock position of a conventional time piece with the second set of hour and minute indicating means being read with respect to said second twelve o'clock representing indicia.

2. A dual time-indicating time piece according to claim 1, wherein said display means for displaying analog time information comprises a series of indicia uniformly distributed around said center, a first semi-circular half of said series being centered about said first twelve o'clock representing indicia and a second semi-circular half of said series being visually distinguishable from the indicia of said first half and centered about said second twelve o'clock representing indicia.

3. A dual time-indicating time piece according to claim 1, wherein said indicating means comprise hour and minute hands wherein the hour hand of each set comprises a portion of a first unitary pointer member coupled to said drive mechanism and the minute hand of each set comprises a portion of a second unitary member coupled to said drive mechanism, and wherein the hands in said first set are visually distinguishable from the hands of said second set in the same manner that the first half of said time indicating indicia is distinguishable from the second half of said time indicating indicia.

4. A dual time-indicating time piece according to claim 2, wherein said indicating means comprise hour and minute hands, wherein the hands in said first set are visually distinguishable from the hands in said second set, and of a different color than the hands comprising said second set, and wherein said first and second twelve o'clock representing indicia are of the same colors as the color of said first and second sets of hands, respectively.

5. A dual time-indicating time piece according to claim 4, wherein said means for displaying time information comprises a first distributed series of indicia of the same color as said first set of hands arranged along an arc centered at said first twelve o'clock representing indicia and a second distributed series of indicia of the same color as said second set of hands arranged along an arc centered at said second twelve o'clock representing indicia.

6. A dual time-indicating wrist watch according to claim 5, wherein said means for coordinating said first and second set of hands with said first and second twelve o'clock representing indicia further comprise first and second sections of watch strap respectively attached to said case substantially at the locations of said first and second twelve o'clock representing indicia, at least a portion of each section being of the same color as that of the adjacent twelve o'clock representing indicia.

7. A dual time-indicating time piece according to claim 1, wherein said means for displaying time information comprises first and second series of indicia arranged uniformly along inner and outer concentric circles, respectively, centered at the point of coupling of said hands to said drive mechanism, and respectively including said first and said second twelve o'clock representing indicia.

8. A dual time-indicating time piece according to claim 1, wherein said first and second twelve o'clock representing indicia are visually distinguishable by shape from other indicia in their respective series and are visually distinguishable by size and color from each other.

9. A dual time-indicating time piece according to claim 8, wherein the hands of said first set are color coordinated with the indicia of said first series and of a length to cooperate therewith, and wherein the hands of said second set are of a different color and shorter than the corresponding hands of said first set and are color coordinated with the indicia of said second series and of a length to cooperate with said second series of indicia.

10. A dual time-indicating time piece according to claim 9, wherein the hour and minute hands of said first and second sets are portions of respective first and second unitary pointer members coupled to said drive mechanism.

11. A dual time-indicating time piece having two distinguishable sets of time indicators for indicating time with respect to two separate and distinguishable reference indicia, said time piece comprising:

means for displaying first and second reference indicia which are linearly displaced from an imaginary center and which are angularly displaced from each other by 180° as measured from said center, said first and second reference indicia being visually distinguishable from each other;

means for displaying a first hour indicator which travels around said center at a rate of one revolution per every twelve hours and which indicates hour time with respect to said first reference indicia, said first hour indicator being visually coordinated with said first reference indicia;

means for displaying a first minute indicator which travels around said center at a rate of one revolution per every sixty minutes and which indicates minute time with respect to said first reference indicia, said first minute indicator being visually coordinated with said first reference indicia;

means for displaying a second hour indicator which travels around said center at a rate of one revolution per every twelve hours and which indicates hour time with respect to said second reference indicia, said second hour indicator being visually coordinated with said second reference marker and visually distinguishable from said first hour indicator, said second hour indicator being continuously angularly displaced from said first hour indicator by 180° as measured with respect to said center;

means for displaying a second minute indicator which travels around said center at a rate of one revolution per every sixty minutes and which indicates minute time with respect to said second reference indicia, said second minute indicator being visually coordinated with said second reference indicia and visually distinguishable from said first minute indicator, said second minute indicator being continuously angularly displaced from said first minute indicator by 180° as measured with respect to said center;

whereby said time piece can be viewed in a first attitude with the first hour and minute indicators being read with respect to the first reference indicia, and whereby said time piece can be viewed in a second attitude in which the second reference indicia is in a position corresponding to the position of the first reference indicia in the first attitude, wherein the second hour and minute indicators can be read with respect to the second reference indicia.

12. A dual time-indicating time piece according to claim 11 wherein said first hour and minute indicator and said second hour and minute indicators comprise hour and minute hands which emanate from said center.

13. A dual time-indicating time piece according to claim 11 wherein said first and second reference markers are linearly displaced from said center by unequal distances.

14. A dual time-indicating time piece according to claim 11 wherein said first reference indicia marks a first twelve o'clock position when the time piece is viewed in the first attitude and wherein the second reference indicia marks a second twelve o'clock position when the time piece is viewed in the second attitude.

15. A dual time-indicating time piece according to claim 14 wherein the first reference indicia comprises an arcuate band centered around said imaginary center, the mid-point of said band marking the first twelve o'clock reference position.

* * * * *